US009451865B2

(12) United States Patent
Kuran et al.

(10) Patent No.: US 9,451,865 B2
(45) Date of Patent: Sep. 27, 2016

(54) DISHWASHER

(75) Inventors: Ayla Kuran, Istanbul (TR); Tolga Akin, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 713 days.

(21) Appl. No.: 12/667,533

(22) PCT Filed: Jul. 2, 2008

(86) PCT No.: PCT/EP2008/058524

§ 371 (c)(1),
(2), (4) Date: Jan. 2, 2010

(87) PCT Pub. No.: WO2009/004037

PCT Pub. Date: Jan. 8, 2009

(65) Prior Publication Data

US 2010/0180919 A1 Jul. 22, 2010

(30) Foreign Application Priority Data

Jul. 4, 2007 (TR) ..... a 2007 04679

(51) Int. Cl.
*A47L 15/00* (2006.01)
*A47L 15/42* (2006.01)

(52) U.S. Cl.
CPC ..... *A47L 15/4231* (2013.01)

(58) Field of Classification Search
CPC ..... A47L 15/4231
See application file for complete search history.

(56) References Cited

U.S. PATENT DOCUMENTS

2005/0017114 A1* 1/2005 Gadini et al. ..... 242/375.1

FOREIGN PATENT DOCUMENTS

DE 2005046391 A1 * 9/2005 ..... A47L 15/42
EP 1810606 A1 * 7/2007

* cited by examiner

*Primary Examiner* — Michael Barr
*Assistant Examiner* — Jason Riggleman
(74) *Attorney, Agent, or Firm* — Venjuris PC

(57) ABSTRACT

The present invention relates to a dishwasher (1) produced without mounting the water softener unit (Y) that is offered for use in places where water hardness is low, but when the water hardness level increases and the water softener unit (Y) is desired to be adapted, only the stopper (10) closing the outlet of the accumulative chamber (6), the lid (11) closing the opening (7) under the tub (2) and the insulations at the electrical connection terminals (8) are removed and the hydraulic, mechanical and electrical connections of the water softener unit (Y) can be easily made by the service-man.

13 Claims, 5 Drawing Sheets

DISHWASHER

The present invention relates to a dishwasher that is produced without mounting a water softener unit but the water softener unit is mounted when required.

In dishwashers, water softener units (Y) are used for decreasing the hardness of water and to provide an effective washing. The water softener unit (Y) is comprised of an ion exchanger (R), a salt container (S) wherein the regeneration process is implemented by keeping the resin in the ion exchanger (R) in salty water in and whereto salt is added in due time by the user and a regeneration valve (V) between the salt container (S) and the ion exchanger (R) for passage of the salt water solution. In order to decrease the hardness of water, the water used in washing is passed through an ion exchanger (R), the ion exchanger (R) cannot absorb the hardness of water as time passes therefore has to be kept in a salt solution at certain intervals for implementing the regeneration process. Besides the regeneration step, water is included in the washing process by directly passing through the resin in the ion exchanger (R). In recent years, the necessity for softening the water in dishwashers has been eliminated in some regions due to improvements in the city water supply. When the water is soft enough, further softening of water by passing through the water softener unit adversely affects the washing performance of the dishwasher. For example, when the hardness level of water is excessively decreased, glass corrosion results, moreover salt will be used unnecessarily in the dishwasher and the usage cost increases for the consumer. In order to overcome these problems, dishwashers without water softener units are produced, however when the water hardness level increases or when moving to a region with a high water hardness level, then hardships are encountered in reassembling a water softener unit to the machine.

In the Patent Application No DE102005046391, in a dishwasher or a washing machine, the water received from outside is collected in an accumulative chamber and a decalcification equipment and a salt container are provided for reducing water hardness and the regeneration processes. When the water hardness level is reduced and the ion exchanger has to be deactivated, then the water in the accumulative chamber is directed into the washing chamber by means of a water supply mechanism.

The object of the present invention is the realization of a dishwasher that is produced without a water softener unit but wherein the water softener unit can be mounted later on.

The dishwasher realized in order to attain the aim of the present invention is explicated in the claims.

The dishwasher of the present invention is produced without assembling the water softener unit, to be used in regions wherein the water hardness is low and is offered for use in this way. In case the water hardness increases or when the dishwasher is wanted to be used in a region wherein water hardness is high, the water softener unit has to be adapted to the dishwasher and therefore the hydraulic, mechanical and electrical connection places of the water softener unit are kept ready in the body.

In the dishwasher, water and electric leakages are prevented by closing or isolating the connection places whereto the water softener unit will be connected in the body. When the water softener unit has to be mounted, these passive connections in the body are activated and the water softener unit connections are made without using additional assembly elements.

In the dishwasher, an accumulative chamber is provided for storing some of the water received from outside to be used in the regeneration process when required and two outlet ports under the said accumulative chamber. The first outlet port is active whether or not the water softener unit is used. The first outlet port is directly connected to the sump with a by-pass hose when the water softener unit is not mounted to the body, and is connected to the ion exchanger included in the water softener unit when the water softener unit is mounted to the body.

The second outlet port is in the passive state when the water softener unit is not mounted to the body but in the active state when the water softener unit is mounted to the body. When the water softener unit is not used, the second outlet port is closed by a stopper preventing water outflow from there and water is delivered to the sump by only passing through the first outlet port. When the water softener unit is used, the stopper is removed from place and the second outlet port is connected to the salt container included in the water softener unit.

In the dishwasher, an opening is provided under the tub for connecting the salt container to the water softener unit such that the mouth thereof opens into the tub and the opening is closed by a lid when the water softener unit is not mounted to the body thereby preventing water from flowing.

In the dishwasher, furthermore electrical connection terminals are provided that are kept insulated when the water softener unit is not mounted to the body and when the water softener unit is mounted, the insulations are removed and connected to the ends of the regeneration valve and thus providing the water softener unit to be activated.

In an embodiment of the present invention, in the dishwasher, a valve having a single inlet and a single outlet is connected to the second outlet port of the accumulative chamber that does not allow water to pass when the water softener unit is not mounted but allows water to be delivered to the salt container when the water softener unit is mounted.

In another embodiment of the present invention, in the dishwasher, a valve having a single inlet and double outlet is connected to the first outlet port of the accumulative chamber, allowing water to be delivered to the by-pass hose when the water softener unit is not mounted and to be delivered to the ion exchanger when the water softener unit is mounted.

The dishwasher realized in order to attain the aim of the present invention is illustrated in the attached figures, where:

Figure 1:
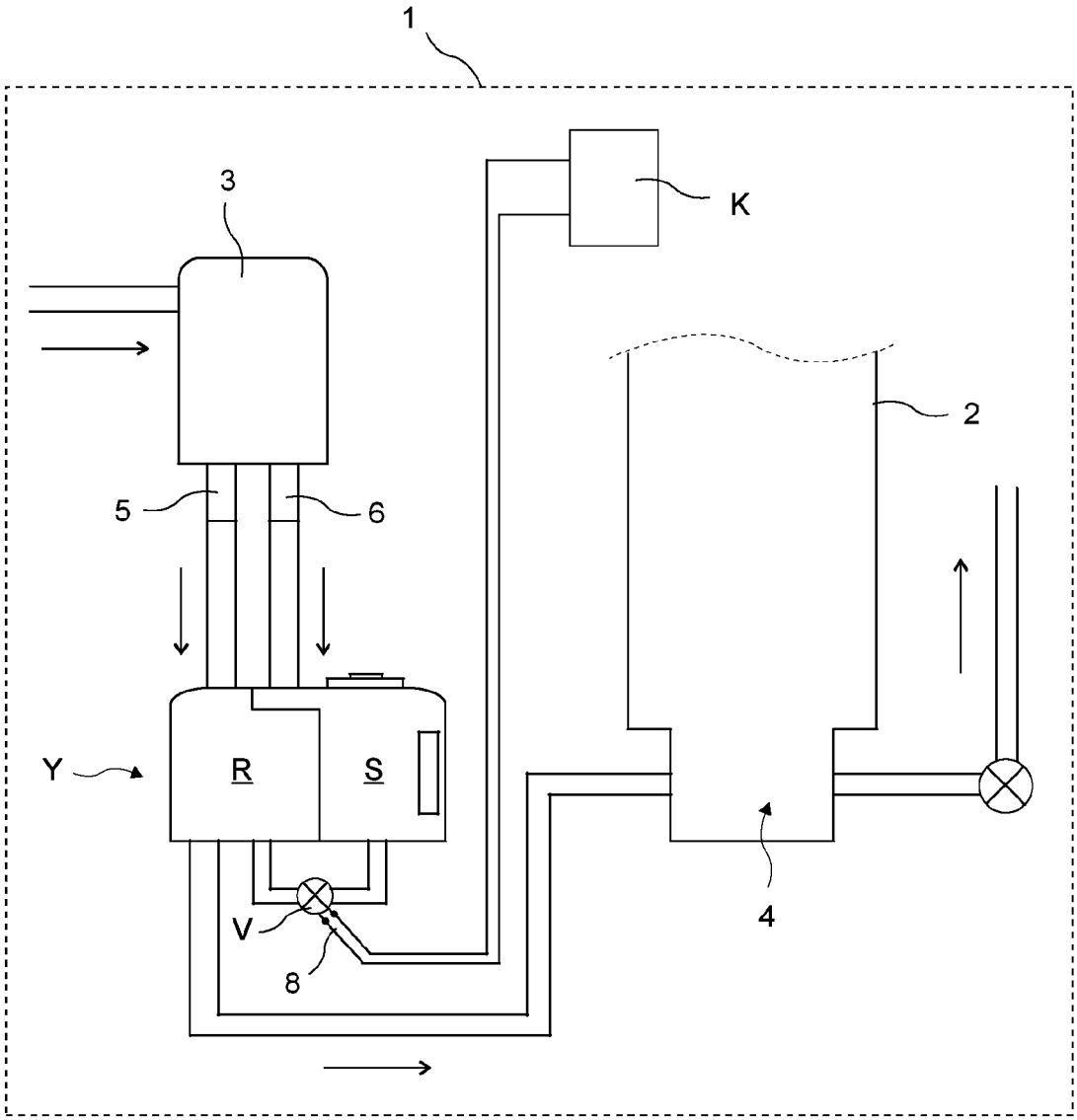
Figure 1 PRIOR ART
FIG. 1 is the schematic view of a dishwasher wherein a water softener unit is mounted in the known embodiment.

The elements illustrated in the figures are numbered as follows:

1. Dishwasher
2. Tub
3. Accumulative chamber
4. Sump
5. First outlet port
6. Second outlet port
7. Opening

8. Electrical connection terminals
9. By-pass hose
10. Stopper
11. Lid
12., 112-Valve The dishwasher (1) comprises a body, a tub (2) wherein the process of washing dishes is performed, an accumulative chamber (3) for storing the water received from the main supply to be used in the regeneration process and a sump (4) under the tub (2) wherein the wash water is collected. The water collected in the sump (4) is sent into the tub (2) by a circulation pump during the washing process and is discharged out of the tub (2) with a discharge pump after the washing.

The dishwasher (1) does not comprise a water softener unit (Y), however is produced such that a water softener unit (Y) can be mounted in cases when required.

In the water softener unit (Y) mounted to the dishwasher (1) when the mains water hardness increases, a salt container (S), an ion exchanger (R) and a regeneration valve (V) for delivering the salt water solution from the salt container (S) to the ion exchanger (R) are included.

Figure 2:
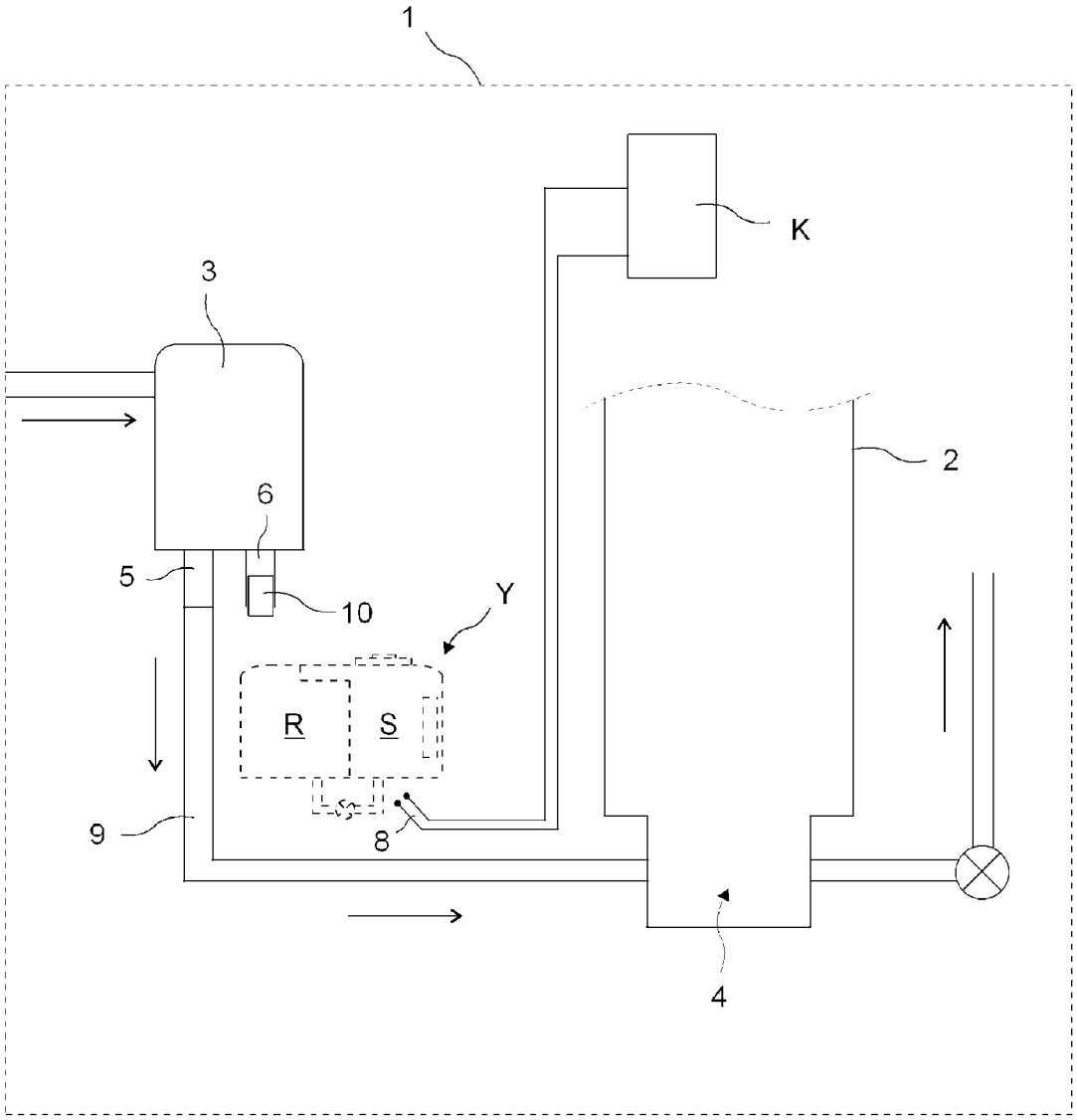
FIG. 2 is the schematic view of a dishwasher wherein a water softener unit is not mounted in the embodiment of the present invention.
Figure 3:
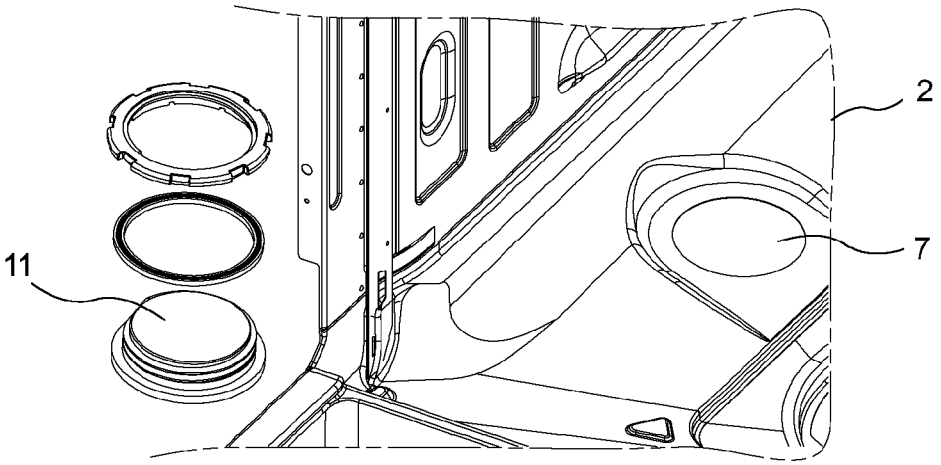
FIG. 3 is the exploded detailed view of a tub, a lid and the assembly elements.

The dishwasher (1) furthermore comprises a first outlet port (5) situated at the accumulative chamber (3) that is activated when the water softener unit (Y) is mounted, delivering the stored water to the ion exchanger (R) for the softening process, a second outlet port (6) for delivering the water to the salt container (S) for regeneration processes, an opening (7) under the tub (2) for connecting the water softener unit (Y) such that the orifice of the salt container (S) opens into the tub (2) and electrical connection terminals (8) connected to the control unit (K) and connected to the ends of the regeneration valve (V) for activating the water softener unit (Y) (FIGS. 2, 3).

The dishwasher (1) of the present invention is produced without mounting the water softener unit (Y) and comprises a by-pass hose (9) that connects the first outlet port (5) to the sump (4) for delivering the water in the accumulative chamber (3) directly to the sump (4). In cases when water hardness is high, the other hydraulic, mechanical and electrical connection places, that are the second outlet port (6), the opening (7) and the electrical connection terminals (8) whereto the water softener unit (Y) will be connected are kept passive by closing or insulating thereby preventing water and electric leakages (FIGS. 2, 3).

While the water softener unit (Y) is mounted to the dishwasher (1) in conditions when required, the upper orifice of the salt container (S) is placed in the opening (7), the first outlet port (5) is connected to the ion exchanger (R) by removing the by-pass hose (9). Similarly, the second outlet port (6) is connected to the salt container (S) and the electrical connection terminals (8) to the regeneration valve (V) (FIG. 1).

The dishwasher (1) comprises a stopper (10) that closes the second outlet port (6) when the water softener unit (Y) is not used for preventing water outflow from there (FIG. 2). When the water softener unit (Y) is mounted to the body the stopper (10) is removed and the second outlet port (6) is connected to the salt container (S).

When the water softener unit (Y) is not used, the water taken from the main supply and collected in the accumulative chamber (3) is directed towards the first and second outlet ports (5, 6) and is not allowed to pass from the second outlet port (6) closed by the stopper (10). Water heads towards the open first outlet port (5) and is delivered to the sump (4) with the by-pass hose (9) connected between the first outlet port (5) and the sump (4) and to the tub (2) from there. When the water softener unit (Y) needs to be used, the second outlet port (6) is connected to the salt container (S) after removing the stopper (10).

Figure 4:
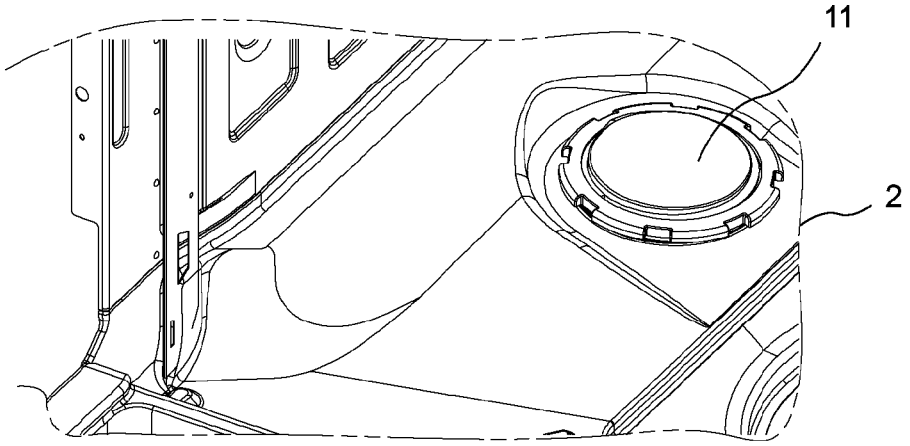
FIG. 4 is the detailed view of a tub, and a lid mounted to the tub.

The dishwasher (1) comprises a lid (11) that closes the opening (7) preventing water to flow when the water softener unit (Y) is not mounted to the body. In the case water hardness is low and the water softener unit (Y) is not used, the opening (7) providing the water softener unit (Y) to be mounted to the tub (2) is closed by the lid (11). When the water softener unit (Y) is to be mounted to the tub (2), the lid (11) is detached and the opening (7) is made available for mounting the water softener unit (Y) (FIGS. 3, 4).

In the dishwasher (1) moreover the electrical connection terminals (8) are insulated by insulation elements when the water softener unit (Y) is not mounted to the body and the insulation elements are removed when the water softener unit (Y) is mounted, and the electrical connection terminals (8) are connected to the ends of the regeneration valve (V) and thus the water softener unit (Y) is activated.

After the electrical connection terminals (8) are connected to the regeneration valve (V), the water softening function is defined for the control unit (K) for example with a button by the user and the control unit (K) energizes the electrical connection terminals (8) whereby the regeneration valve (V) is operated.

Figure 5:
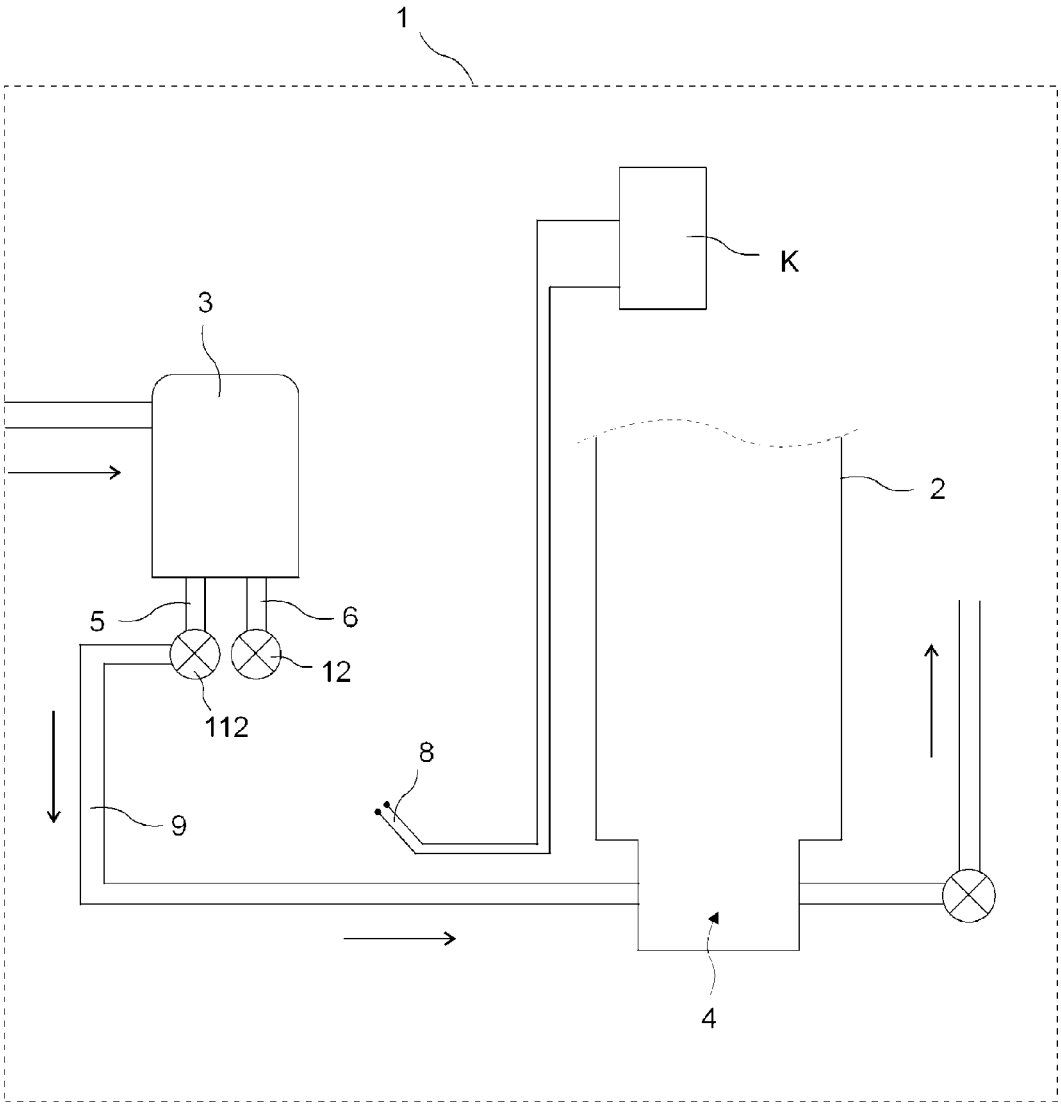
FIG. 5 is the schematic view of a dishwasher wherein a water softener unit is not mounted in another embodiment of the present invention.
Figure 6:
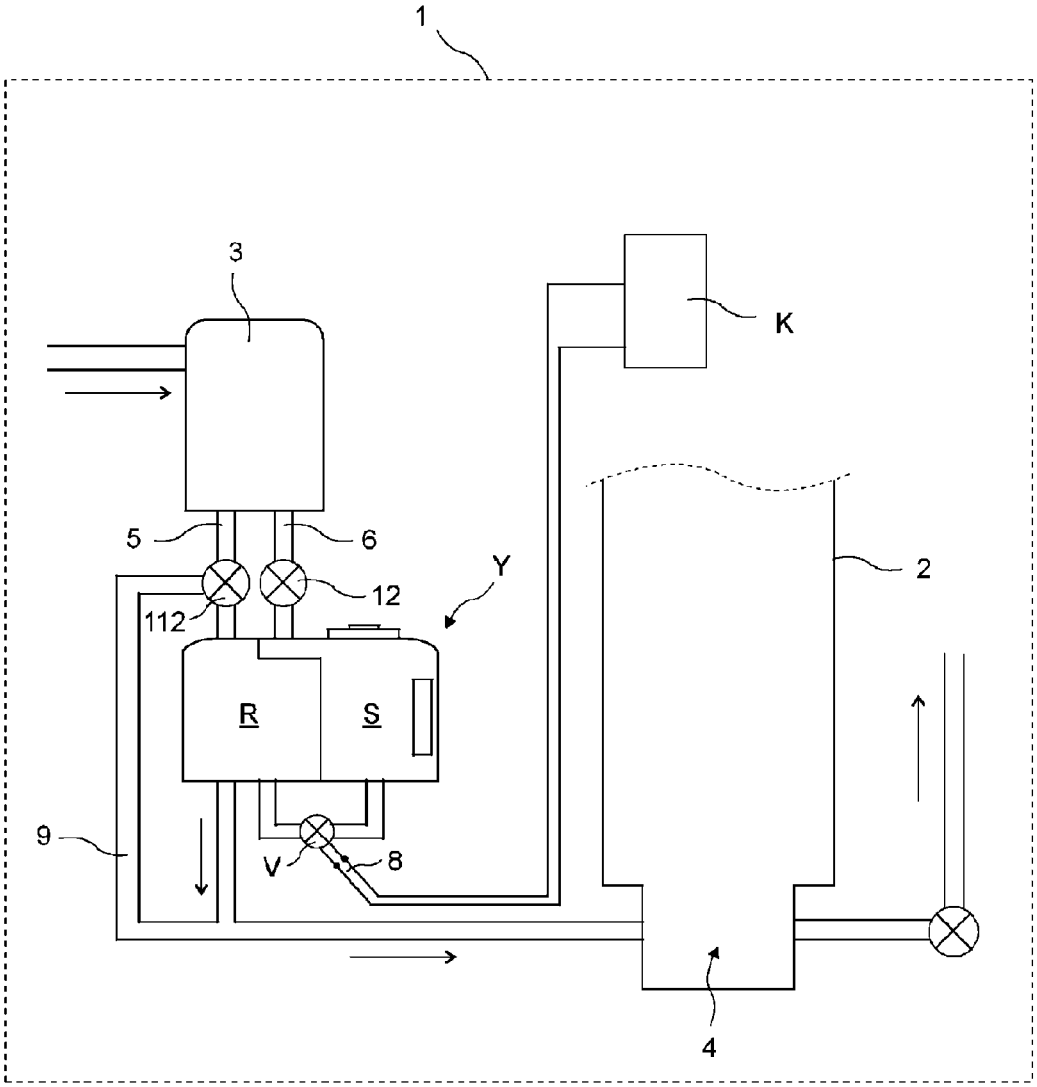
FIG. 6 is the schematic view of a dishwasher wherein a water softener unit is mounted in the embodiment in FIG. 5.

In an embodiment of the present invention, the dishwasher (1) comprises a valve (12) having a single inlet and a single outlet, that is connected to the second outlet port (6) closing the second outlet port (6) when the water softener unit (Y) is not mounted but allowing water to be delivered to the salt container (S) from the second outlet port (6) when the water softener unit (Y) is mounted (FIGS. 5, 6).

In this embodiment, the valve (12) is used in place of the stopper (10), being kept closed when the water softener unit (Y) is not mounted preventing water flow from the second outlet port (6) and is activated when the water softener unit (Y) is mounted, allowing water to flow from the accumulative chamber (3) to the salt container (S). In this embodiment, activating the valve (12) only when the water softener unit (Y) is mounted and closing when the water softener unit (Y) is not desired to be used is sufficient.

In another embodiment of the present invention, the dishwasher (1) comprises a valve (112) having a single inlet and double outlet, that is connected to the first outlet port (5) allowing water to be delivered to the by-pass hose (9) from the first outlet port (5) when the water softener unit (Y) is not mounted and to be delivered from the first outlet port (5) to the ion exchanger (R) when the water softener unit (Y) is mounted (FIGS. 5, 6).

In this embodiment, the valve (112) directs water to the by-pass hose (9) from the first outlet thereof when the water softener unit (Y) is not mounted, and directs water to the ion exchanger (R) when the water softener unit (Y) is mounted by means of the second outlet. In this embodiment, mounting and dismounting processes are not necessary in cases when the water softener unit (Y) is used or not used; only the two outlets of the valve (112) are used for directing water to the intended place.

The dishwasher (1) of the present invention is produced and offered for use without assembling the water softener unit (Y), additional devices for deactivating the water softener unit (Y) are not used and a reduction in costs is provided. When the water softener unit (Y) is desired to be adapted to the dishwasher (1), only the stopper (10), the lid (11) and insulations in the electrical connections (8) are removed for making the hydraulic, mechanical and electrical connections of the water softener unit (Y).

The invention claimed is:

1. A dishwasher comprising a body, a tub wherein the process of washing dishes is performed, a sump under the tub wherein wash water is collected, an accumulative chamber for storing water received from a main supply, the accumulative chamber having a first outlet port and a second outlet port, an opening in the tub for connecting a water softener unit wherein the water softening unit includes a regeneration valve, and wherein the accumulative chamber is connected to the tub or the sump by a by-pass hose that connects the first outlet port to the sump for delivering the water in the accumulative chamber directly to the sump when the water softener unit is not connected and when the water softener unit is connected, and by connecting the second outlet port, the opening, the water softener unit and the electrical connection terminals, and wherein the second outlet port, the opening, the water softener unit and the electrical connection terminals are, however, kept passive by closing or insulating the second outlet port and the electrical connection terminals when the water softener unit is not installed.

2. The dishwasher as in claim 1, further comprising a stopper that closes the second outlet port when the water softener unit is not used, thereby preventing water outflow from there.

3. The dishwasher as in claim 1, further comprising a lid that closes the opening when the water softener unit is not used thereby preventing water from flowing.

4. The dishwasher as in claim 1, further comprising a valve having a single inlet and a single outlet, that is connected to the second outlet port and closing the second outlet port when the water softener unit is not mounted but allowing water to be delivered to the salt container from the second outlet port when the water softener unit is mounted.

5. The dishwasher as in claim 1, further comprising a valve having a single inlet and double outlet, that is connected to the first outlet port and allowing water to be delivered from the first outlet port to the by-pass hose when the water softener unit is not mounted and to be delivered from the first outlet port to the ion exchanger when the water softener unit is mounted.

6. The dishwasher as in claim 2, further comprising a lid that closes the opening when the water softener unit is not used thereby preventing water from flowing.

7. The dishwasher as in claim 3, further comprising a valve having a single inlet and a single outlet, that is connected to the second outlet port and closing the second outlet port when the water softener unit is not mounted but allowing water to be delivered to the salt container from the second outlet port when the water softener unit is mounted.

8. The dishwasher as in claim 6, further comprising a valve having a single inlet and a single outlet, that is connected to the second outlet port and closing the second outlet port when the water softener unit is not mounted but allowing water to be delivered to the salt container from the second outlet port when the water softener unit is mounted.

9. The dishwasher as in claim 2, further comprising a valve having a single inlet and double outlet, that is connected to the first outlet port and allowing water to be delivered from the first outlet port to the by-pass hose when the water softener unit is not mounted and to be delivered from the first outlet port to the ion exchanger when the water softener unit is mounted.

10. The dishwasher as in claim 3, further comprising a valve having a single inlet and double outlet, that is connected to the first outlet port and allowing water to be delivered from the first outlet port to the by-pass hose when the water softener unit is not mounted and to be delivered from the first outlet port to the ion exchanger when the water softener unit is mounted.

11. The dishwasher as in claim 4, further comprising a valve having a single inlet and double outlet, that is connected to the first outlet port and allowing water to be delivered from the first outlet port to the by-pass hose when the water softener unit is not mounted and to be delivered from the first outlet port to the ion exchanger when the water softener unit is mounted.

12. A dishwasher comprising a body, a tub wherein the process of washing dishes is performed, a sump under the tub wherein wash water is collected, an accumulative chamber for storing water received from a main supply, the accumulative chamber having a first outlet port and a second outlet port, an opening in the tub for connecting a water softener unit wherein the water softening unit includes a regeneration valve, and wherein the accumulative chamber is connected to the sump or the tub by selecting from the group consisting of a by-pass hose that connects the first outlet port to the sump for delivering the water in the accumulative chamber directly to the sump when the water softener unit is not used and when the water softener unit is used, and by connecting the second outlet port, the opening, the water softener unit and the electrical connection terminals, and wherein the second outlet port, the opening, the water softener unit and the electrical connection terminals are, however, kept passive by closing or insulating the second outlet port and the electrical connection terminals when the water softener unit is not installed.

13. The dishwasher in claim 12, further comprising a first valve having a single inlet and a single outlet, the first valve inlet being connected to the second outlet port, the first valve closing the second outlet port when the water softener unit is not connected, and wherein the first valve is operable to allow water to be delivered to a salt container of the water softener unit from the second outlet port when the water softener unit is connected.

* * * * *